US007150667B1

(12) United States Patent
Leung

(10) Patent No.: US 7,150,667 B1
(45) Date of Patent: Dec. 19, 2006

(54) METAL AIR BATTERY AND BUOYANCY MODULE FOR LIFE VESTS

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 36 days.

(21) Appl. No.: 10/975,118

(22) Filed: Oct. 27, 2004

(51) Int. Cl.
*B63C 9/125* (2006.01)
*B63C 9/08* (2006.01)

(52) U.S. Cl. ..... 441/89; 441/106

(58) Field of Classification Search ..... 441/88–124
See application file for complete search history.

(56) References Cited

U.S. PATENT DOCUMENTS 3,090,979 A * 5/1963 Segrest ..... 441/94
3,621,501 A * 11/1971 Jordan ..... 441/89
4,237,526 A * 12/1980 Wood ..... 362/158
4,885,217 A * 12/1989 Hoge ..... 429/27
5,458,516 A * 10/1995 Uglene et al. ..... 441/104
5,603,648 A 2/1997 Kea
6,087,996 A 7/2000 Dery
6,439,941 B1 8/2002 McClure et al.
6,464,742 B1 10/2002 Leung et al.
6,492,046 B1 12/2002 Payne et al.

* cited by examiner

*Primary Examiner*—Sherman Basinger
(74) *Attorney, Agent, or Firm*—Michael Zelenka; George B. Tereschuk

(57) ABSTRACT

An individual flotation device includes a shell that has a cavity for receiving air and a housing that is connected to the shell. The housing has a metal air battery compartment that is dimensioned and configured to receive a metal air battery and also has an aperture. The housing may be located on the shell such that the aperture will generally remain above water during use of the flotation device. A membrane that may comprise hydrophobic properties may be located within the aperture of the housing.

6 Claims, 2 Drawing Sheets

METAL AIR BATTERY AND BUOYANCY MODULE FOR LIFE VESTS

GOVERNMENT INTEREST

The invention described herein may be manufactured, used, imported, sold, and licensed by or for the Government of the United States of America without the payment of any royalty thereon or therefor.

BACKGROUND OF THE INVENTION

1. Field of the Invention

The present invention relates generally to survival devices and, more particularly, to power sources for use with such devices.

2. Related Art

The Department of Defense has recently stated that the development of lightweight and longer lasting survival devices for fixed wing and rotary aircraft crews is a high priority. It has been found that, in general, a reduction in the weight of survival devices is beneficial both during normal operation and during emergency operation. In the case of normal operation, the wearer and the equipment benefits from a reduced weight through increased performance (especially for high performance aircraft) and, in the case of emergency operation, the wearer will benefit by an increased mobility and buoyancy.

One example of a survival device is shown in FIGS. 1A and 1B of U.S. Pat. No. 6,439,941 to McClure et al. This patent describes a flotation system that supports a satellite radio-telephone 14, a transmission antenna 16, an immersion sensor 18, a GPS receiver 20 and antenna system 22 all powered by a battery pack 24. The battery pack 24 uses high-powered lithium batteries that may last up to four days by transmitting on an intermittent basis.

However, to date, no generally light weight and sufficiently high capacity battery has been employed with survival devices such as life vests.

SUMMARY OF THE INVENTION

In accordance with an embodiment of the present invention, an individual flotation device comprises a shell that has a cavity for receiving air and a housing that is connected to the shell. The housing comprises a metal air battery compartment that is dimensioned and configured to receive a metal air battery and also comprises an aperture. The housing may be located on the shell such that the aperture will generally remain above water during use of the flotation device. A membrane that may comprise hydrophobic properties may be located within the aperture of the housing.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns an individual flotation device that comprises a metal air battery that has more than three times the energy, by weight, of lithium and mercury batteries available today.

Figure 1:
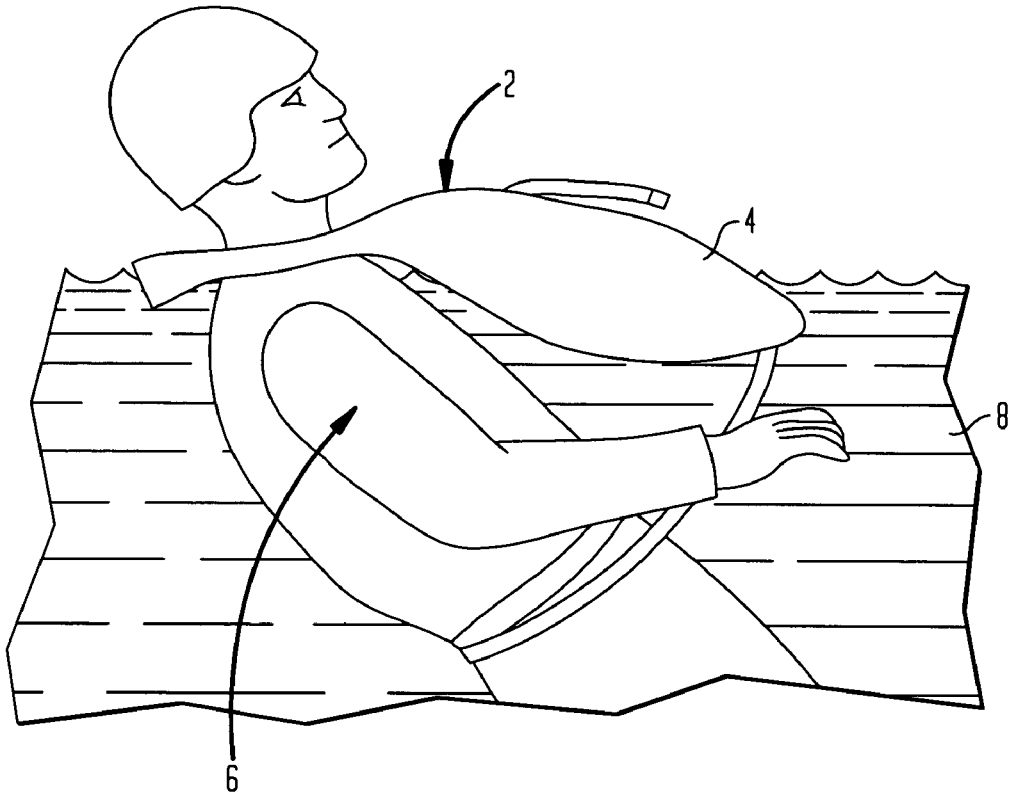
FIG. 1 is a side view of a soldier wearing a life vest comprising a metal air battery module in accordance with an embodiment of the present invention.

Referring now to FIG. 1, an individual flotation device 2 comprises a generally known construction including a flexible outer shell 4, composed of, e.g., a polymeric substance, and a central cavity 5 (FIG. 3) filled with a gaseous medium such as air (not shown). The flotation device 4 may be operated, as shown, by a soldier 6 who has been ejected from a downed aircraft (not shown) and is floating in a body of water 8.

Figure 2:
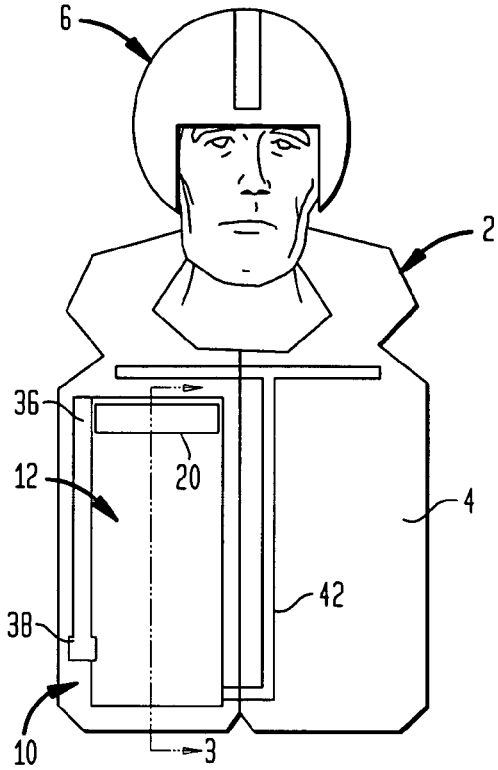
FIG. 2 is a front view of the soldier, life vest and metal air battery module of FIG. 1.
Figure 3:
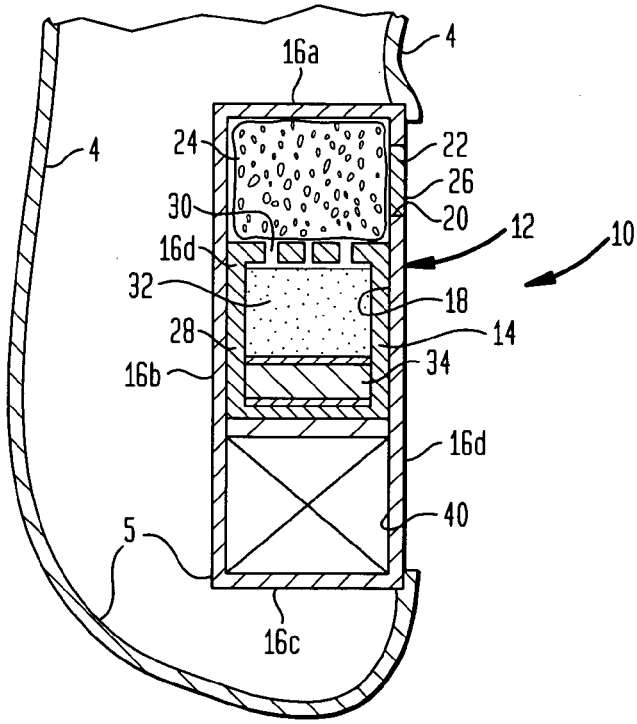
FIG. 3 is an enlarged, cross sectional view taken along line III of FIG. 2 and showing an interior portion of the metal air battery module of FIG. 1.

Referring now to FIGS. 2 and 3 and in accordance with one embodiment of the present invention, a metal air battery module is illustrated generally at 10. In this embodiment, the metal air battery module 10 comprises a housing 12 and a metal air battery 14.

The housing 12 may include a generally rectangular shape in cross section and may comprise a composite, polymeric substance similar to that of the shell 4. In such a case, both the shell 4 and the housing 12 may be molded during fabrication and then adhered together. In one example, the housing comprises a medium density polyethylene.

The housing 12 may comprise walls 16*a*, 16*b*, 16*c*, which are located within the central cavity 5 of the shell 4, and a wall 16*d* that may be generally planar with the shell 4. The walls 16*a*, 16*b*, 16*c* and 16*d* may define a generally rectangular shape in cross-section in addition to a metal air battery compartment 18. An aperture 20, having a generally rectangular configuration may be provided in a wall 16*d*. The aperture 20 and wall 16*d* is located on the shell 4 such that it will remain above the water 8 (see FIG. 1).

A hydrophobic membrane 22 may be located within the battery compartment 18 and, for example, may comprise polyamide or polytetrafluoroethylene. One suitable polyamide membrane is sold by the General Electric Company under the mark Magna Nylon Hydrophobic Membrane. The membrane 22 may function to prevent the ingress of water into the metal air battery compartment and may be adhered to an air permeable spacer 24.

A cover 26, such as an adhesive tape, may be fastened over the membrane 22 to maintain a vacuum seal and prevent the passage of oxygen into the metal air battery compartment 18 prior to desired operation of the individual flotation device 2. During operation of the flotation device 2 and upon removal of the cover 26, air may fill the battery compartment 18 and provide for the operation of the metal air battery 14, as described below. Optionally, the cover 26 may be at least partially composed of, and/or adhered by, a water soluable material to aid in the event of an unconscious soldier 6.

The metal air battery 14 may be constructed in a known manner and may comprise a gas permeable container 28 comprising openings 30, an anode 32 and a cathode 34. The container 28 may comprise a nickel plated steel wherein openings 30 provide for the passage of oxygen. The anode 32 may comprise a gel composed of zinc and an electrolyte and the cathode 34 may comprise a binder, carbon particles and a reducing agent such as a manganese compound. During operation, oxygen from air may initiate operation of the battery 14 by being reduced at the cathode and forming metal oxides at the anode. Further details of a metal air battery may be found in U.S. Pat. No. 6,492,046 to Payne et al which is hereby incorporated herein by reference.

An electrical cable 36 and connector 38 may be employed to conduct electrical energy from the metal air battery 14 to power additional equipment such as an emergency radio.

Optionally, the metal air battery module 10 may further comprise a transmitter/receiver compartment 40 in which a transmitter, receiver and/or GPS receiver (none of which are shown) may be positioned. Referring back to FIG. 2 now, there is depicted the metal air battery module 10, housing 12, aperture 20, electrical cable 36, connector 38 and an antenna 42. The antenna 42 is depicted in a T-shaped configuration, but other suitable configurations and arrangements are also possible. The antenna 42 may be thin film antenna further comprising a metallic substance deposited on thin film antenna's substrate, and may be positioned on the shell 4 as shown in FIG. 2 for enhanced transmission and reception.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. An individual flotation device comprising:

a shell having a cavity for receiving air;

a housing, being integrally connected to the shell, further comprises a metal air battery placed in a metal air battery compartment and an aperture;

the housing is located on the shell such that the aperture generally remains above water during use of the flotation device and is composed of a polymeric substance;

the aperture having a membrane with hydrophobic properties;

a connector cable is coupled to the metal air battery;

the housing having a transmitter compartment with a transmitter located therein; and an antenna is disposed on the shell.

2. A survival flotation system, comprising:

a shell having a cavity to receive air and a thin film antenna disposed thereon;

a housing, being integrally connected to the shell, further comprises a metal air battery placed in a metal air battery compartment, an aperture and a transmitter compartment;

the housing, being located on the shell such that the aperture generally remains above water during use of the flotation system, is composed of a polymeric substance;

the aperture having a membrane with hydrophobic properties;

a connector cable is coupled to the metal air battery;

a transmitter is located within the transmitter compartment; and the thin film antenna further comprising a substrate having a metallic substance deposited on the substrate.

3. The individual flotation device, as recited in claim 1, further comprising a polyamide hydrophobic membrane.

4. A survival flotation apparatus, comprising:

a shell having a cavity for receiving air;

a housing having a metal air battery compartment and an aperture;

the housing is located on the shell such that the aperture generally remains above water during use of the survival flotation apparatus;

the aperture having a membrane with hydrophobic properties; and an adhesive tape including an oxygen barrier for covering the aperture and the membrane to prevent operation of the metal air battery prior to desired use.

5. The survival flotation system, as recited in claim 2, further comprising a polyamide hydrophobic membrane.

6. The survival flotation apparatus, as recited in claim 4, further comprising a polyamide hydrophobic membrane.

* * * * *